US012312152B2

(12) United States Patent
Kloebbe

(10) Patent No.: US 12,312,152 B2
(45) Date of Patent: May 27, 2025

(54) ACTUATING DEVICE FOR USE IN COMBINATION WITH A PRESSURIZED PACKAGING

(71) Applicant: Colgate-Palmolive Company, New York, NY (US)

(72) Inventor: Jürgen Kloebbe, Pulheim (DE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 18/251,491

(22) PCT Filed: Nov. 26, 2021

(86) PCT No.: PCT/IB2021/061014
§ 371 (c)(1),
(2) Date: May 2, 2023

(87) PCT Pub. No.: WO2022/113017
PCT Pub. Date: Jun. 2, 2022

(65) Prior Publication Data

US 2024/0034543 A1 Feb. 1, 2024

(30) Foreign Application Priority Data

Nov. 26, 2020 (CH) ..... 01505/20

(51) Int. Cl.
*B65D 83/206* (2025.01)
*B65D 83/14* (2006.01)
*B65D 83/64* (2006.01)

(52) U.S. Cl.
CPC ..... *B65D 83/753* (2013.01); *B65D 83/206* (2013.01); *B65D 83/64* (2013.01)

(58) Field of Classification Search
CPC ..... B65D 83/206; B65D 83/164
(Continued)

(56) References Cited

U.S. PATENT DOCUMENTS 3,777,947 A 12/1973 Klema
8,444,023 B2 5/2013 Rossignol
(Continued)

FOREIGN PATENT DOCUMENTS

EP 0098476 1/1984
EP 0461894 12/1991
(Continued)

OTHER PUBLICATIONS

International Search Report and the Written Opinion of the International Searching Authority issued in International Application PCT/IB2021/061014 mailed Mar. 23, 2022.

*Primary Examiner* — Paul R Durand
*Assistant Examiner* — Randall A Gruby

(57) ABSTRACT

A novel actuating device (1) is described for use in combination with a pressurized packaging (6), which comprises an actuator head (2) having a discharge orifice (11), a discharge duct (3) which connects the discharge orifice with an entry port (4). The actuating device is provided for actuating a resilient biased valve means for dispensing the fluid from the fluid container (6) and further comprises an open piston (16) having at least an upper sealing lip (20) which is sealing towards an inner wall of the discharge duct (3). An inner rod (25) is attached to the open piston (16) having a free end (26; 53) for closing the discharge orifice (11). The open piston (16) is biased towards the discharge opening: The actuator head (2) comprises a lever (31) for actuating the open piston (16) towards the entry port of the discharge duct (3).

13 Claims, 10 Drawing Sheets

(58) Field of Classification Search
USPC ..... 222/402.13, 518, 402.25, 501, 402.15, 222/470
See application file for complete search history.

(56) References Cited

U.S. PATENT DOCUMENTS

| | | | | |
|---|---|---|---|---|
| 10,086,395 | B2 * | 10/2018 | Goettke | B05B 11/1074 |
| 10,829,295 | B2 * | 11/2020 | Rasel | B65D 83/20 |
| 2005/0211798 | A1 * | 9/2005 | Garcia | B65D 83/20 239/320 |

FOREIGN PATENT DOCUMENTS

| | | |
|---|---|---|
| FR | 2948343 | 1/2011 |
| GB | 1445202 | 8/1976 |
| JP | 4975559 | 7/2012 |
| JP | 5128253 | 1/2013 |
| WO | 2009/072203 | 6/2009 |

* cited by examiner

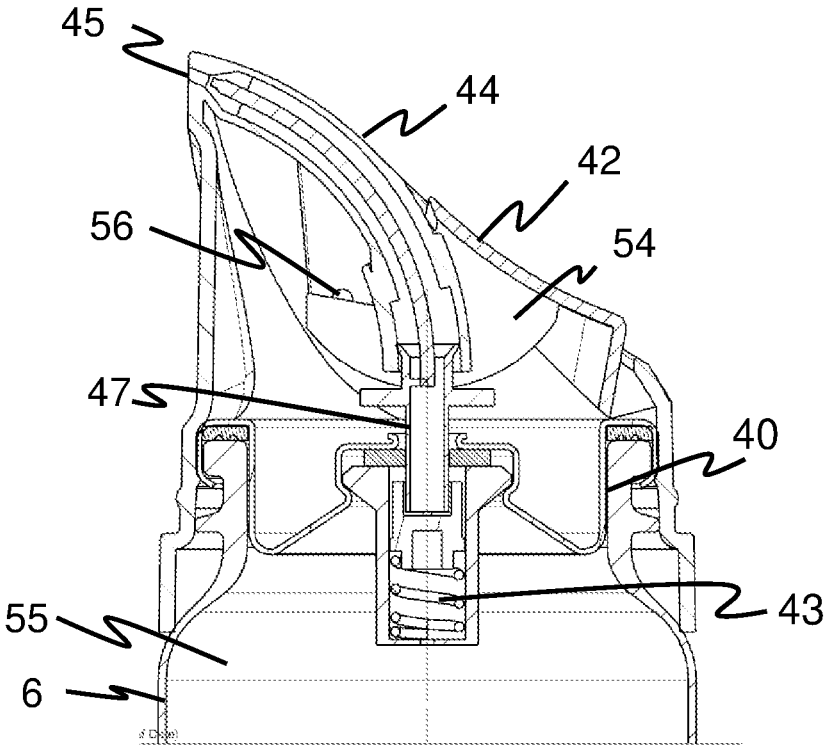
Fig.8B
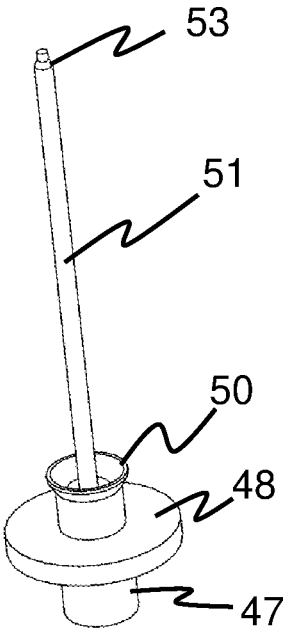
Fig.9A
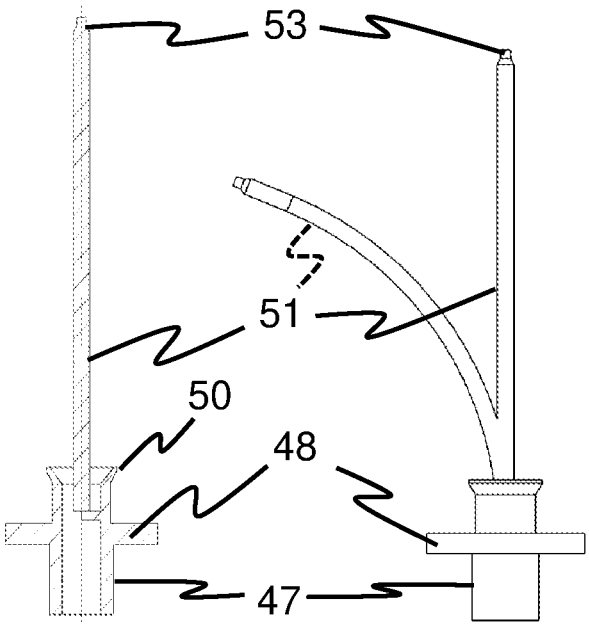
Fig.9B
Fig.9C

ACTUATING DEVICE FOR USE IN COMBINATION WITH A PRESSURIZED PACKAGING

The invention is related to an actuating device for use in combination with a pressurized packaging according to the preamble of claim 1.

FIELD OF THE INVENTION

Valves and actuators are well established elements used in a vast majority of aerosol dispensers, which are fully integrated in the consumer market and available for many applications like spray painting, dispensing whipped cream, air fresheners, hairspray etc. Typically those products are build-up from a container (aluminum, tinplate or plastic), a valve mechanism, and actuator combined with a closing cap. A valve is fluid tight connected to the pressurized packaging. The valve is usually composed of a cup, sealing elements and a valve mechanism. Mainly metal is used for the cup. The actuator conduit is connected to the valve stem. These products are in use for several decades and elements of the final consumer product like container, valve mechanism, actuators and caps are typically manufactured by different suppliers, whereas all elements usually come together at the filling line and paired with the filled container after which the system will be pressurized and eventually decorated.

BACKGROUND OF THE INVENTION

EP 0 461 894 A2 describes a finger actuated plunger head of a dispenser which has a protector cap pivotally mounted thereon and normally disposed for covering the discharge orifice. The cap is pivotally movable relative to the plunger head upon application of the finger force to the cap in the direction of plunger head reciprocation for uncovering the orifice. The cap is resiliently urged into its normal orifice-covering position upon removal of the applied finger force. The protector cap is covering the plunger head and the discharge orifice from the outside, and thus the dried out product between the protector cap and the plunger head potentially prevents the protector cap from jumping back into the orifice-covering or rest position.

Thus, the above mentioned protector cap and wiper for a dispenser discharge orifice may prevent more or less clogging of foam outside the orifice after dispensing, however, it can not prevent that dried foam is blocking the orifice if the aerosol dispenser is not used for a longer period.

It is an object of the present invention to provide an actuating device for use in combination with a pressurized packaging, in which closing of the orifice is effectively guaranteed to prevent the valve from clogging and protect the product against oxidation, and which is designed with less parts as in known actuators.

This object is solved by an actuating device comprising an actuator head having a discharge orifice, a discharge duct in the actuator head which discharge duct connects the discharge orifice with an entry port, remote from the orifice, which actuating device is provided for actuating a resilient biased valve means for dispensing the fluid from the fluid container, wherein the actuating device comprises an open piston having an open front end, an open rear end and at least an upper sealing lip which is sealing towards an inner wall of the discharge duct, whereas an inner rod is attached to the open piston having a free end, which free end is closing the discharge orifice from the inside of the discharge duct, whereas the open piston is biased towards the discharge opening, the actuator head comprising a lever or push button for actuating the open piston towards the entry port of the discharge duct.

In a preferred embodiment the open piston has a larger diameter at the front end as the diameter at the rear end, such that an overpressure in the packaging urges the inner rod towards the duct orifice, thus providing the resilient biased valve means.

In another preferred embodiment the open piston is provided to actuate a straight actuated valve with a hollow valve stem.

In an advantageous embodiment an upper container closure with an outer upstanding rim and an inner central tube is provided for closing the fluid container.

An additional resilient means can be provided in a further preferred embodiment between the upper container closure and an outstanding flange of the open piston for supporting the biasing force on the open piston.

It is advantageous if the additional resilient means are bellows or is a spring made of metal or plastic.

All elements of the actuating device are preferably made from a plastic material.

Further, the discharge duct may be curved and the inner rod can be made from a flexible plastic material, in order to adapt to the curved discharge duct. For user convenience it is preferred to have the dispensing orifice positioned at an angle relative to the container centerline This embodiment of the invention makes it possible to stepless vary the orifice angle between 0° and 90° relative to the container centerline.

In another preferred embodiment the open piston has two opposite upstanding activation ribs, whereas the open piston with the inner rod, the free end and the upstanding ribs is preferably made of one piece from a plastic material.

The push button preferably has an inner cam which is actuating the outstanding flange of the open piston.

Further, the inner wall of the discharge duct may be provided with longitudinal guiding ribs to prevent against twisting or buckling of the inner rod.

In another preferred embodiment, the inner rod is provided with guiding elements which cooperate with the longitudinal guiding ribs.

Preferably, the discharge orifice is provided by a circular rim of the discharge duct and the rim has a thickness between 0 and 2.0 mm to reduce the amount of residual product outside the discharge orifice.

Additional advantages can be derived from the following description of preferred embodiments of the invention.

BRIEF DESCRIPTION OF THE DRAWINGS

The invention will now be described in greater detail, by way of example, with reference to the accompanying drawings, in which:

FIG. 8B shows a cross-section of the second embodiment in open condition, FIGS. 9A, 9B, 9C show an open piston with an elongated closing rod or needle.

DETAILED DESCRIPTION OF THE PREFERRED EMBODIMENTS

In all figures the same elements have the same reference numbers, if not mentioned otherwise.

Figure 1:
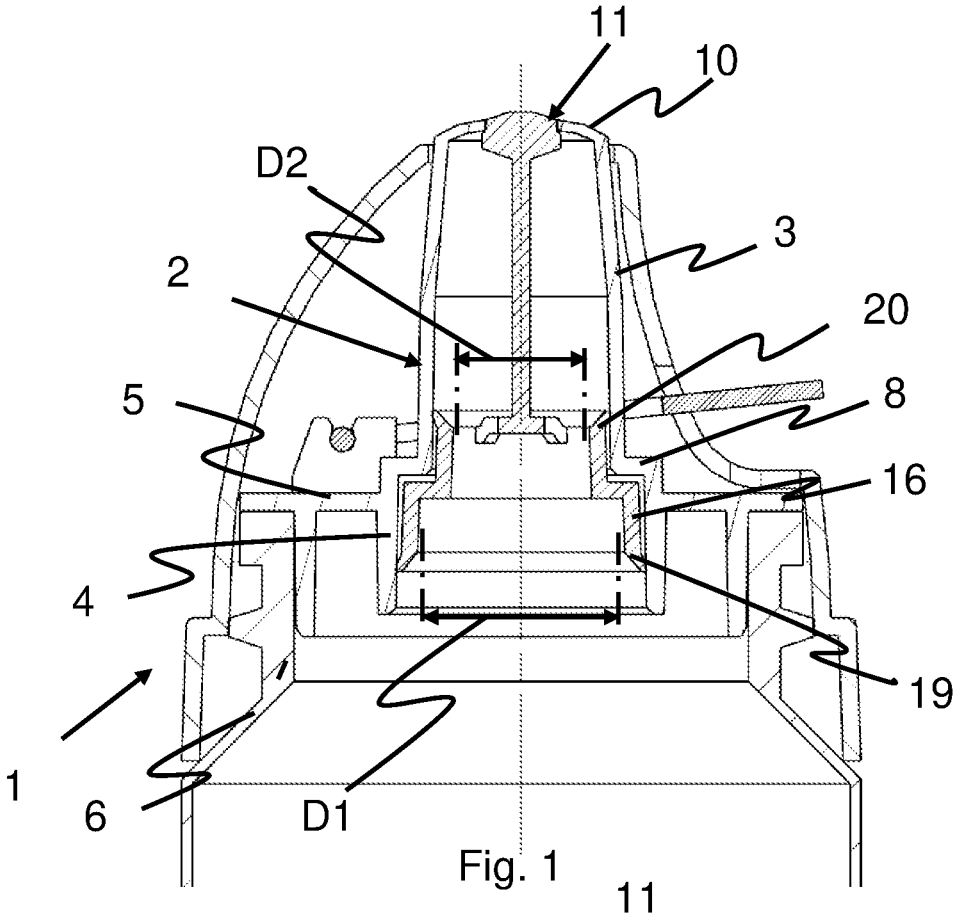
FIG. 1 shows a cross-section of a first embodiment of an actuating device according to the invention in closed condition.
Figure 2:
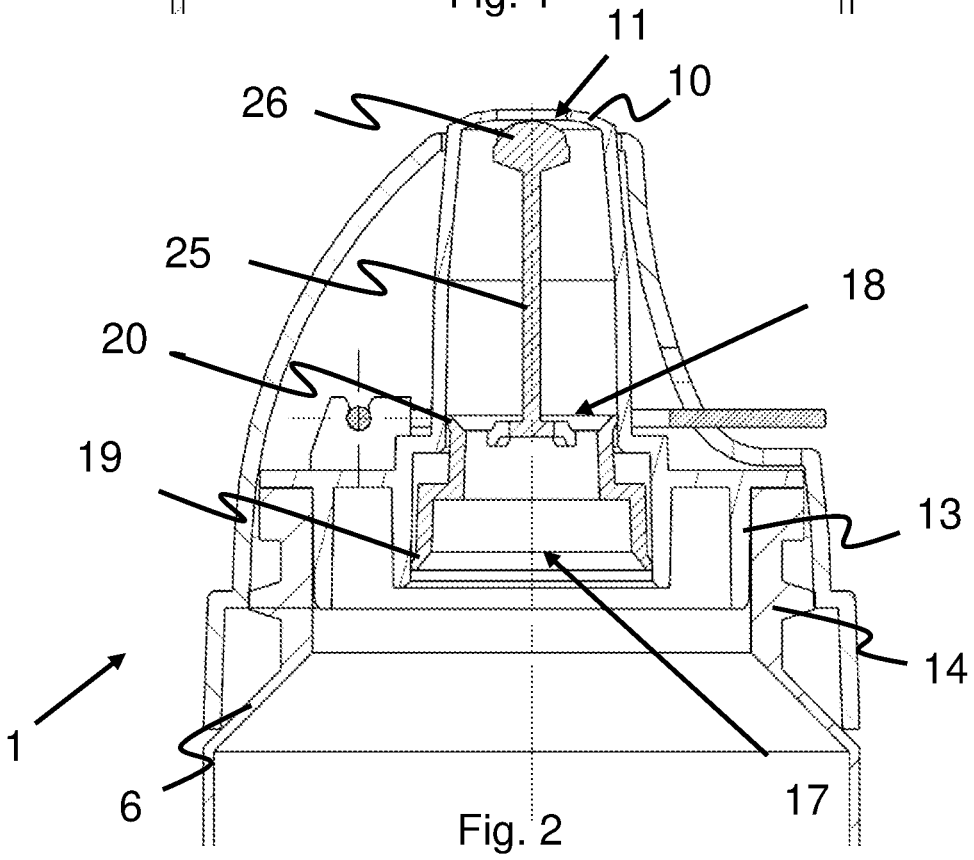
FIG. 2 shows a cross-section of the actuating device of FIG. 1 in open condition.

In FIGS. 1 and 2 a first embodiment of the actuating device 1 is shown, which has an actuator head 2 comprising a discharge duct 3, a piston chamber 4 and a upper container closure 5, which will be mounted and secured to or integrated with a packaging or fluid container 6 to be pressurized. The piston chamber 4 is ring-shaped and protruding downwards from the disc-shaped closure 5, thus providing an entry port for the discharge duct 3. Further the piston chamber 4 is also protruding upwards from the disc-shaped closure 5 and has an inner step 8, which merges into the discharge duct 3. The discharge duct 3 has a dome-shaped closing end 10 with a discharge orifice 11. The closing end 10 may also be tapered. The disc-shaped closure 5 has a downwardly protruding ring-shaped rim 13, which is clamped in or connected to (e.g. by welding, gluing, snapping) the neck portion 14 of the fluid container 6 (which is only partly depicted).

Within the piston chamber 4 a stepped open piston 16 is provided, which has an open front end 17 towards the entry port 4 and an open rear end 18 towards the discharge duct 3. At the front end 17 a lower ring-shaped sealing lip 19 and at the rear end 18 an upper ring-shaped sealing lip 20 is provided. The diameter D1 of the open piston 16 at the front end is larger as the diameter D2 at the rear end (in flow direction), so that there is a net force on the open piston 16 towards the discharge orifice 11 according to the following equation:

$$F=(\pi/4*D1^2-\pi/4*D2^2)*P,$$

Whereas, F is force and P is pressure on the fluid in the fluid container 6.

Figure 3:
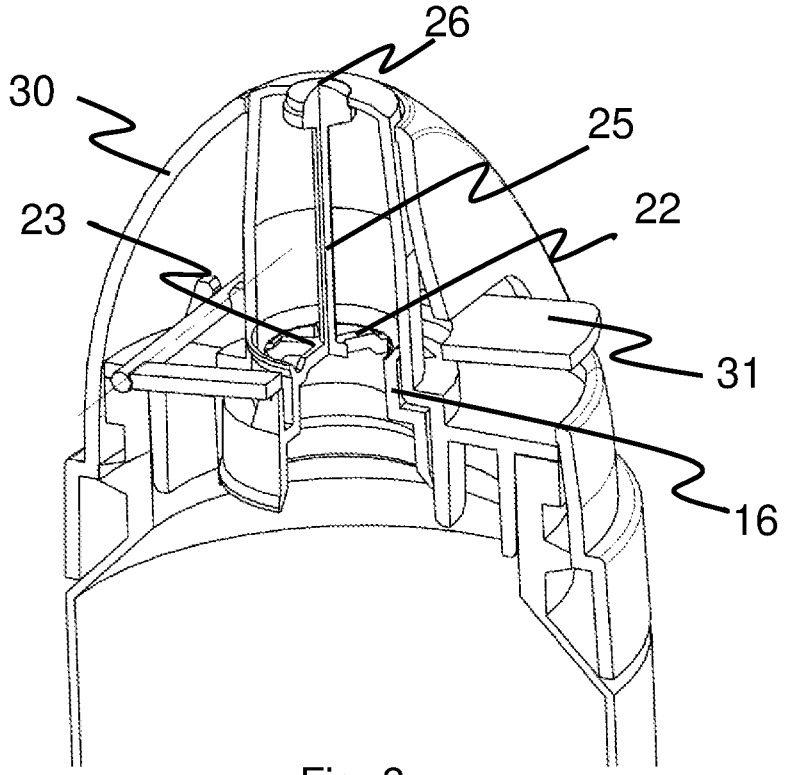
FIG. 3 shows a cross-section of the actuating device according to FIG. 1 in perspective view.
Figure 4:
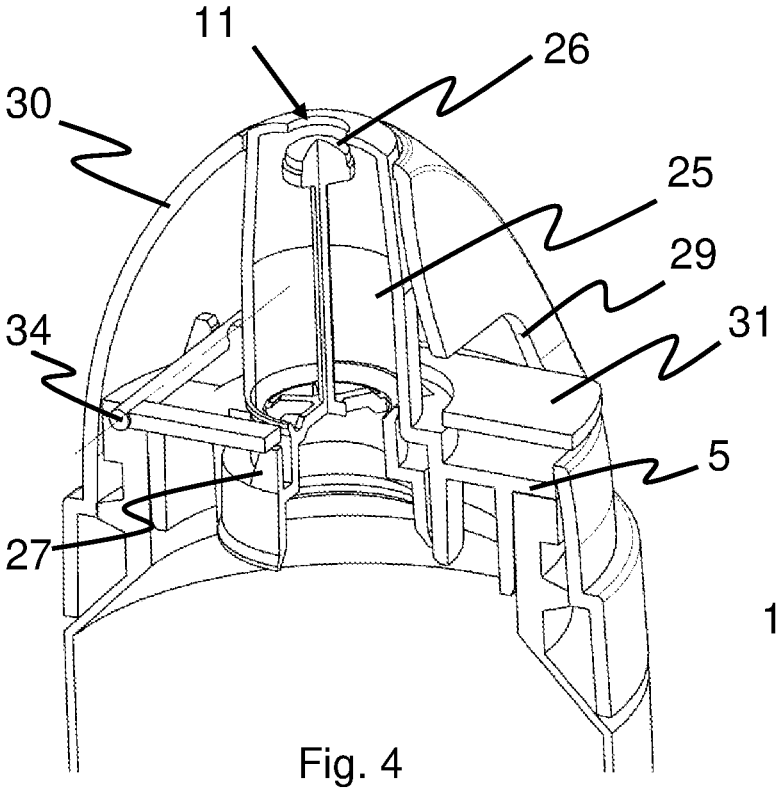
FIG. 4 shows a cross-section of the actuating device according to FIG. 2 in perspective view.
Figure 4A:
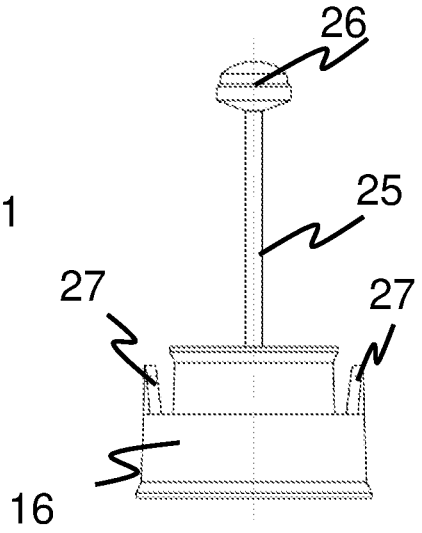
FIG. 4A shows a front view on the open piston with two upstanding activation ribs.

As can be seen in more detail in FIGS. 3 and 4 a spoke crossing 22 is mounted at the upper end of the open piston 16, whereas at the crossing point 23 an elongated inner rod 25 with a dome-shaped closing end 26 is mounted, which inner rod 25 is extending in the longitudinal direction of the discharge duct 3. In the closed position as shown in FIGS. 1 and 3, the dome-shaped closing end 26 is sealing the discharge orifice 11 from the inside of the discharge duct 10. The open piston 16 with the inner rod 25 and closing end 26 is made in one-piece of plastic material.

Figure 4B:
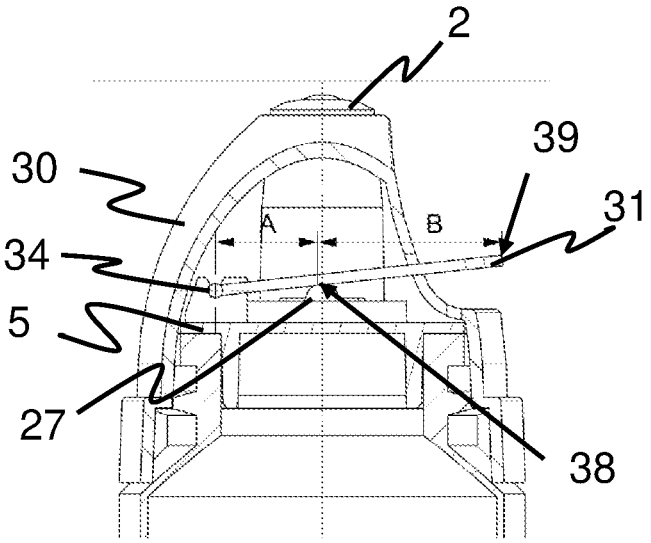
FIG. 4B shows an off center cross section displaying one of the upstanding activation ribs

A design housing 30 with a lever 31 is covering the actuator head 2. The lever 31 has a pivot 34 which is integrally connected with actuator head 2. In this manner the lever 31 is rotatably connected to the upper container closure 5. As can be seen in 4A the open piston 16 has two opposite ribs 27, which protrude upwards from the stepped open piston 16, and is further protruding through corresponding slots in the upper container closure 5 (see FIG. 4B), whereas in the housing 30 a matching opening 29 is provided (see FIG. 4), so that the lever 31 can be activated by the user which in turn, over the defined leverage ratio, will activate the protruding or upstanding ribs 27 and thus open the discharge orifice 11. In FIG. 4 one of the upstanding ribs 27 can also be seen. FIG. 4 is cut on the position where the lever 31 touches the protruding piston ribs 27. The open piston 16 with inner rod 25, closing end 26 and upstanding ribs 27 is preferably made of one piece. A distance A between the pivot 34 and a contacting point 38 of the lever 31 on the upstanding ribs 27 and a distance B between the contacting point 38 and the end 39 of the lever 31 define the transmission ratio of the pushing movement of lever 31 on the open piston 16 (see FIG. 4B). By changing the ratio between distance A and distance B the leverage function can be adjusted to the best consumer convenience.

Figure 5:
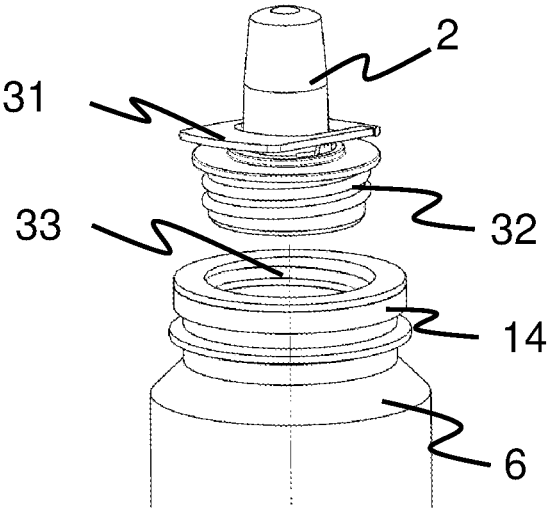
FIG. 5 shows in perspective view part of a fluid container with a discharge duct with a screwing thread and a closure cap with lever.

In FIG. 5 the upper container closure is shown in exploded view with an outer screw thread 32, which can be screwed into an inner screw thread 33 of the neck portion 14 of the packaging or fluid container 6. The design housing has matching opening 29 for the lever 31 (see FIG. 4). As an alternative to a fixed connection from upper container closure 5 to the packaging or container 6, an inside or outside thread could be used. For environmental reasons it could be efficient, in waste separation or re-use, to manually separate the actuating device 1 from the packaging or fluid container 6.

Figure 6:
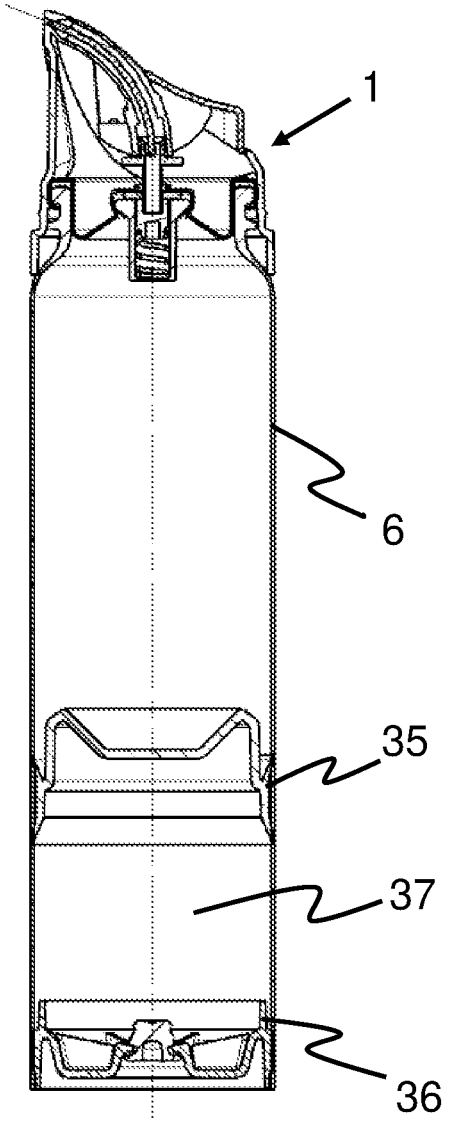
FIG. 6 shows a cross-section of a second embodiment of the actuating device mounted on a fluid container wherein the hollow piston activates a straight actuated female valve.

In FIG. 6 a set-up of a second embodiment of the actuating device 1 with a fluid container 6 and a fluid pressing piston 35, a container bottom closure 36 and an overpressure chamber 37 between the fluid pressing piston 35 and the container bottom closure 36 is depicted. In this example the packaging or fluid container 6 is pressure driven, whereas a piston 35 is provided to transfer the force in order to dispense the content. However, the piston 35 can be replaced by a Bag-On-Valve or diptube system. For the present invention any product delivery device, driven by any other energy source (stored in the package or delivered during use) like electricity or human power, may be used.

Figure 7:
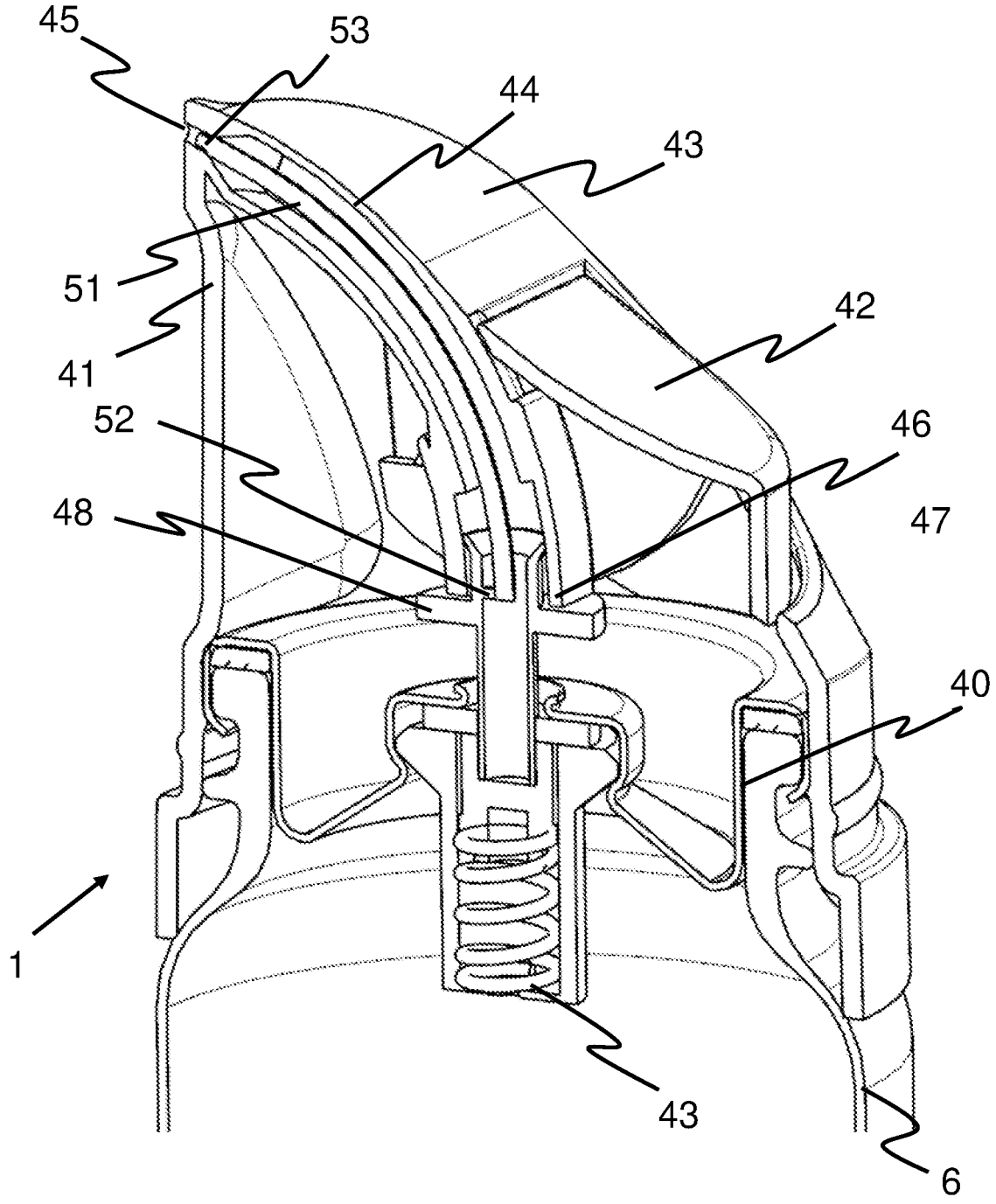
FIG. 7 shows a cross-section of the second embodiment in perspective view.

FIG. 7 shows a perspective view on a cross-section of the second embodiment of the actuating device 1. The fluid container 6 is provided with a metal crimped female valve 40 with a straight valve biased by a metal spring 43. The actuating device 1 has an actuating head 41 with a push button 42 which is pivotally mounted in the actuating head 41. The actuating head 41 has rounded beveled top 43 which covers a curved discharge duct 44, which has at its front end a discharge orifice 45. The discharge duct 44 is extending inwardly and ending with an inner end 46. An open piston 47 with an outstanding flange 48 is provided at the inner end 46 of the discharge duct 44, which flange 48 is pushed to the inner end 46. The discharge duct 44 is further ending with the inner end 46 at a distance to the metal crimped valve 40, which distance is defined by the thickness of the piston flange 48 plus the actuating stroke of the straight valve 40. An elongated flexible rod 51 is connected with spoke-like connection rods 52 to the inner wall of the open piston 47, which rod 51 is provided with a tip end 53 to seal the discharge orifice 45 from the inside. The tip end 53 may be conical or dome shaped. In FIG. 7 the outlet valve, provided by the discharge orifice 45 and the rod 51 with tip end 53, is closed.

Figure 8A:
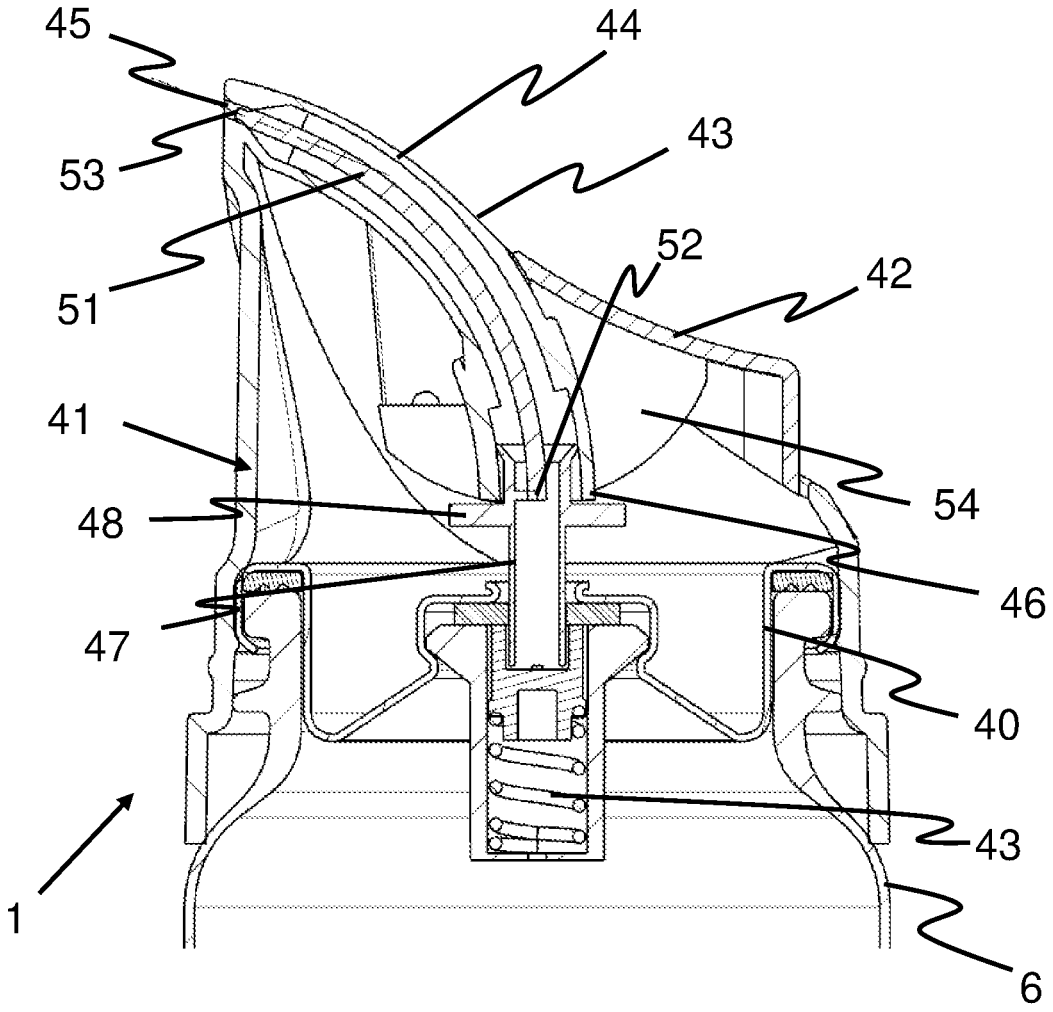
FIG. 8A shows a cross-section of the second embodiment in closed condition.

In FIG. 8*b* the actuating device 1 of the second embodiment is shown in the open position of the outlet valve, which is provided by the discharge orifice 45 and the rod 51 with the conical end tip 53.

The push-button 42 has two inner curved cams 54 (in FIG. 7 only one cam is depicted), which are laying at both sides on the outstanding flange 48 of the open piston 47. By pushing the push-button 42 downwards as shown in FIG. 8*b* the piston flange 48 is driven and on its turn the piston end opening the female valve and fluid 55 of the packaging or fluid container 6 is flowing into the discharge duct 46 and through the discharge orifice 45. In fact two valves are opened in one action, both the crimped valve 40 fixed to the container upper end, and the discharge orifice 45. The curvature profile of the cams 54 and a pivot 56 (see FIG. 8*b* in the actuating head 41 defines the transmission rate of the movement of the push-button 42 to the movement to the open piston 47 and the metal crimped valve 40—similar to the lever function as in the first embodiment. By adjusting the profile or curvature of the cams 54 the transmission ratio can be set in order to obtain the best possible ergonomic feeling for actuating.

As can be seen in FIGS. 9A to 9C, the open piston 47 has an upper ring-shaped sealing lip 50, which is sealing against the inner wall of the discharge duct 44. As mentioned above, the elongated flexible rod 51 with the spoke like connection rods 52 is connected inside to the open piston 47, whereas the conical or tapered end tip 53 seals the discharge orifice 45 from the inside of the discharge duct 44. In this embodiment of the open piston 47 the diameter at the front end and the diameter at the rear end are the same. In this embodiment the force to end tip 53 into the actuator seat of the discharge orifice 45 is provided by the metal spring 43 inside the straight valve 40.

Figure 10:
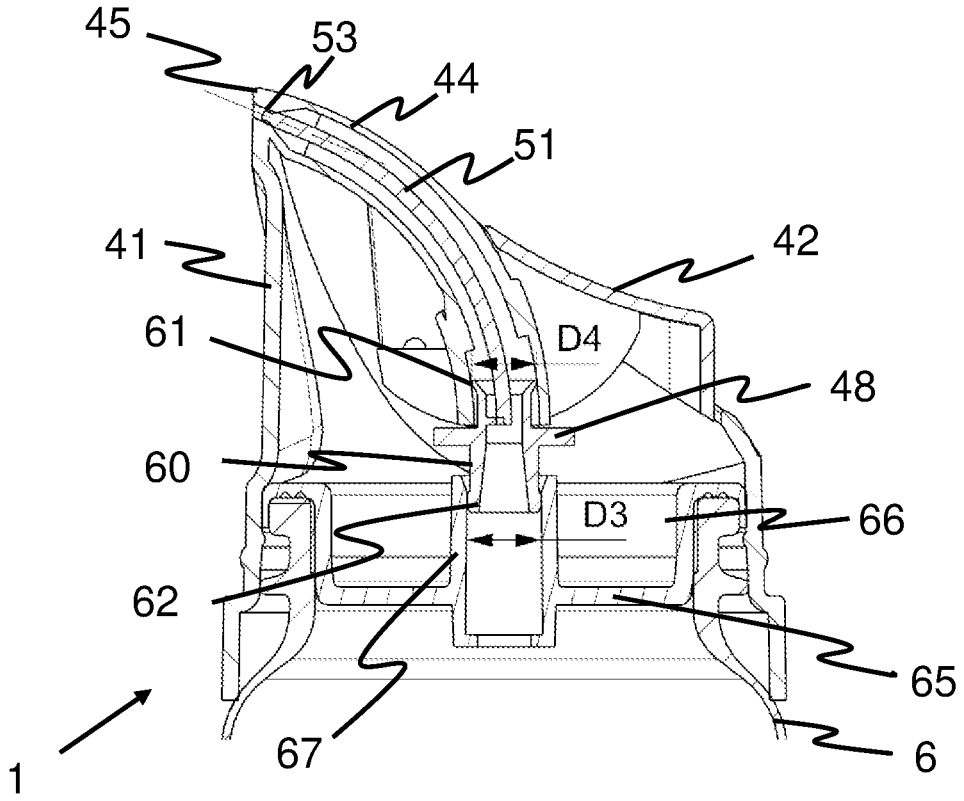
FIG. 10 shows a first variation of the second embodiment in cross-sectional view, wherein the closing force is derived from the fluid pressure.

In FIG. 10 a variation of the actuating device 1 is shown, which is a combination of the embodiment of FIG. 1 and the embodiment of FIG. 7. The curved discharge duct 44 is the same as in FIG. 7. However, the open piston 60 has a sensible smaller diameter D4 at the rear end as the diameter D3 at the front end (in flow direction) providing an upward force from the pressure of the propellant gas in the packaging or fluid container 6. In addition, the open piston 60 has an upper sealing lip 61 and a lower sealing lip 62. As in the embodiment of the open piston 47 there is provided an elongated flexible rod 51 with a conical tip end 53. Further the metal crimped valve 40 is replaced by an upper container closure 65 with an upstanding outer rim 66 and an inner central tube 67, which upper container closure 65 with outer rim 66 is fixed to the inner wall of the packaging or fluid container 6. However, fixation can also be arranged by in inside or outside screw thread connection. The upper sealing lip 61 is sealing the open piston 60 towards the inner wall of duct 44 and the lower sealing lip 62 is sealing the open piston 60 towards the inner wall of the central tube 67. Thus, the interior of the packaging or fluid container 6 is over the open piston 60 in sealed contact with the discharge duct 44, so that fluid flowing from the packaging or fluid container 6 cannot escape to the outside. Further, according to Pascal's law the applied pressure is equal in all direction for a closed system. As force F is defined by the product of pressure P and area A, i.e. F=P*A, the upward force is higher due to the diameter difference in both D3 and D4. This force is driving the orifice sealing by the tip end 53 of the flexible rod 51.

Figure 11:
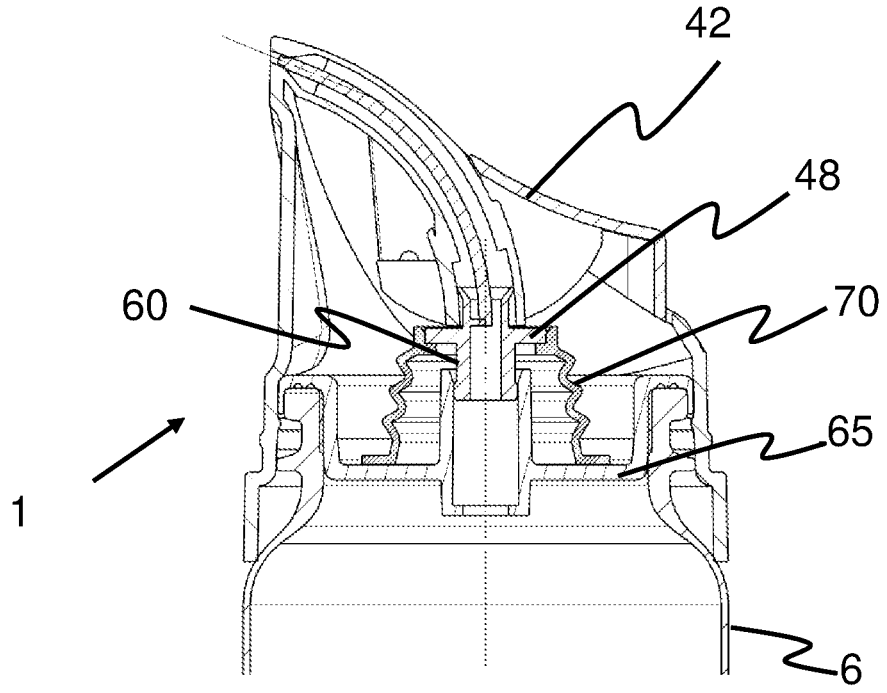
FIG. 11 shows a second variation of the second embodiment in cross-sectional view.

In FIG. 11 a variation of the embodiment of FIG. 10 of the actuating device 1 is shown, wherein the biasing force on the open piston 60 is additionally supported by flexible bellows 70, which are clamped between the upper closure 65 and the piston flange 48. The bellows 70 is an additional resilient means to make sure that the valve will close automatically in case of an unexpected pressure drop. UN 1950 Aerosole is prescribing such a feature.

Figure 12:
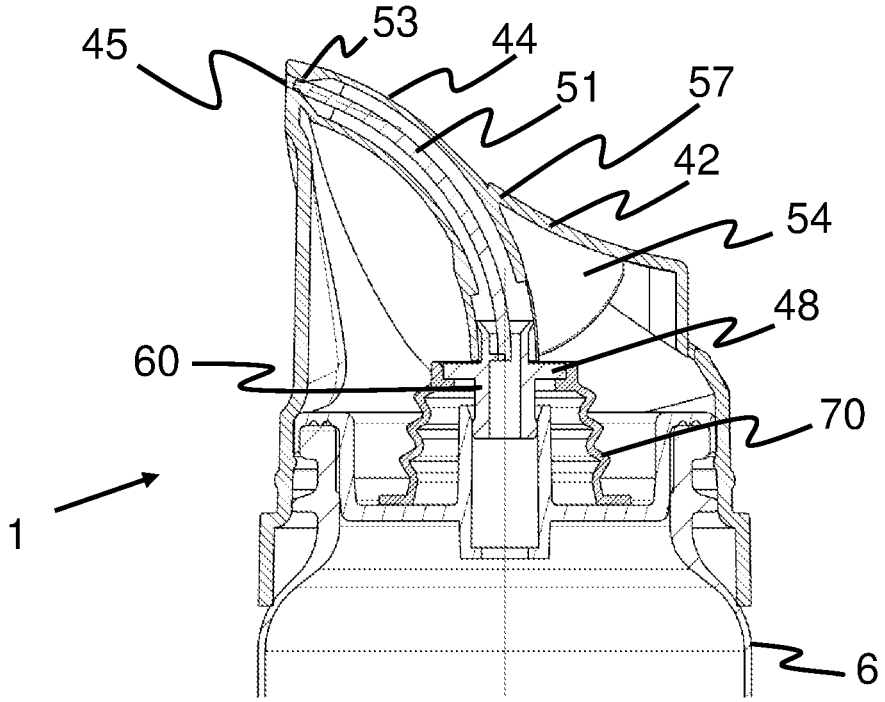
FIG. 12 shows a slight amendment of the second variation of the second embodiment in cross-sectional view.
Figure 13:
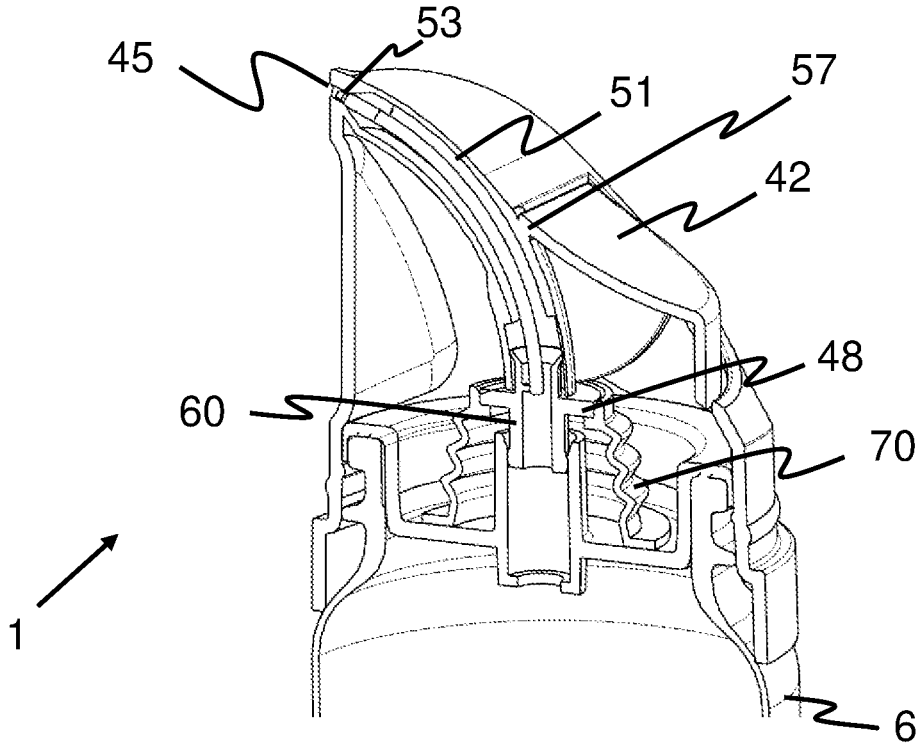
FIG. 13 shows the embodiment of FIG. 12 in cross-section and in perspective view.

In FIG. 12 a variation of the embodiment of FIG. 11 of the actuating device 1 is shown, in which the push-button 42 is integrally connected to the discharge duct 44 at a joint 57, so that the push-button 42 with the cam 54 is pivoting around the joint 57. FIG. 13 is a perspective view of FIG. 12.

Figure 14:
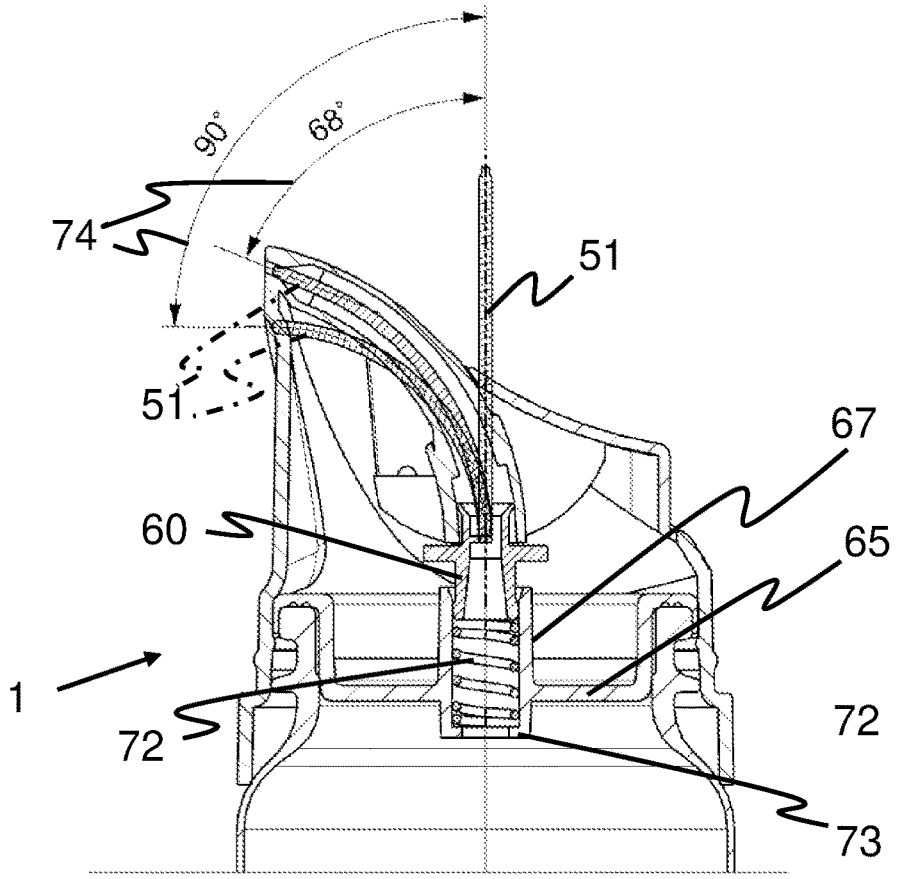
FIG. 14 shows a cross section of the second embodiment indicating possible orifice positions, wherein the orifice position is designed at an angle of 68° to the vertical.

FIG. 14 is a further variation of the embodiments of FIGS. 11 to 13 in which the bellows 70 is replaced by metal spring 72 provided in the inner central tube 67 of the closure 65. The inner central tube 67 has an inward circular rim 73 which supports the metal spring 72 towards the lower end of the open piston 60. Further FIG. 14 shows different curvatures of the discharge duct 44, so that the position of the discharge orifice 45 is changed in an angle 74 towards the vertical. The angle 74 may vary between 0° and 90°. Experiments have shown that the most optimal angle 74 is at 68°.

Figure 15:
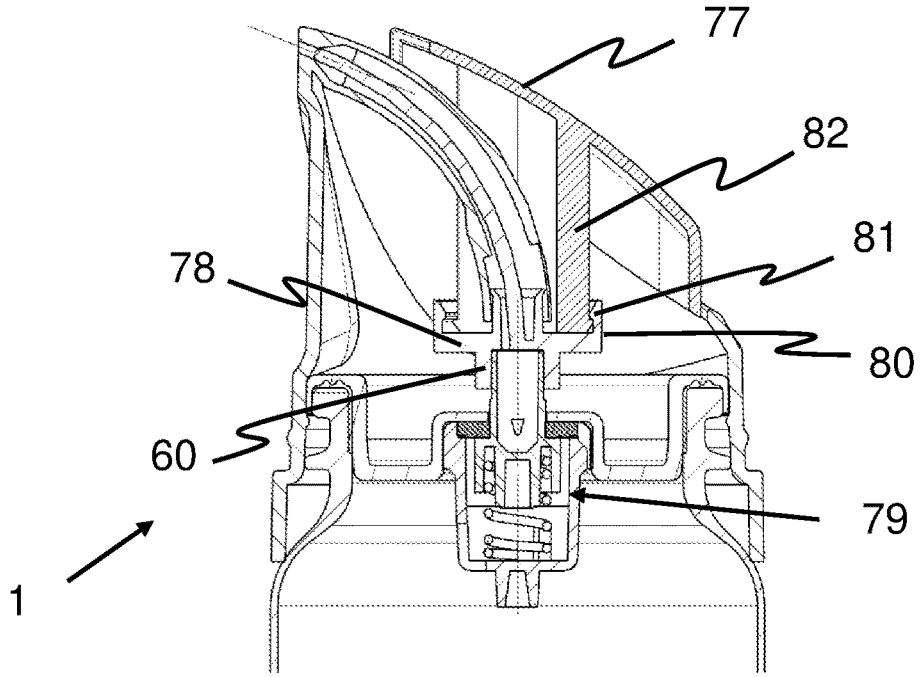
FIG. 15 shows another option for the straight actuated push-button of the actuating device. In this example a straight action male valve is used.

FIG. 15 shows another variation of the second embodiment of the actuating device 1, in which the pivoting push-button 42 is exchanged by an axial actuated push-button 77 which is supported on an outer flange 78 of the open piston 60 which in turn actuates a male valve 79 of packaging or fluid container 6. The outer flange 78 has an upstanding rim 80 with an undercut 81 in order to clamp an inwardly protruding carrier 82 of the push-button 77, so that the push-button 77 is fixedly connected to the open piston 60.

The embodiment of the actuating device 1 according to FIGS. 1 to 5 is made of plastic material. Preferably plastic resins are accepted in the recycling stream. With todays available commercialized technology this means that PET and Polyolefin are used which are easy to separate by float method. PET will sink and should have the prescribed purity able to use it for the solid state process which upgrades it back to the process quality. For polyolefin parts it is recommended to use one type like PP only. However, other plastic materials can be used which allow welding with the packaging or fluid container 6 which is made from PET or from any other thermoplastic polyester. As welding methods e.g. friction welding, ultrasonic welding and laser welding can be used to join the upper container closure 5 with the neck portion of the packaging or fluid container 6.

The embodiment of the actuating device 1 according to FIGS. 7 to 15 is also made of plastic material, preferably a plastic with a density of less than 1 g/cm$^3$. Especially, the actuating head 41 is made of PP, the push button 42 is also made of PP and the elongated rod 51 is preferably made from PP. Depending on the desired flexibility (orifice angle) a more flexible material might be needed like PE.

The design of the embodiment of FIGS. 7 to 15 allows to position the discharge orifice 45 in any angle between 0° and 90° relative to the dispenser centreline as indicated in FIG. 14. The flexible rod 51 allows a stepless angle position which makes it possible to use the same flexible valve as in FIG. 9 for more actuator designs. The choice of the dispense angle is considered a great convenience factor in use.

Figure 16:
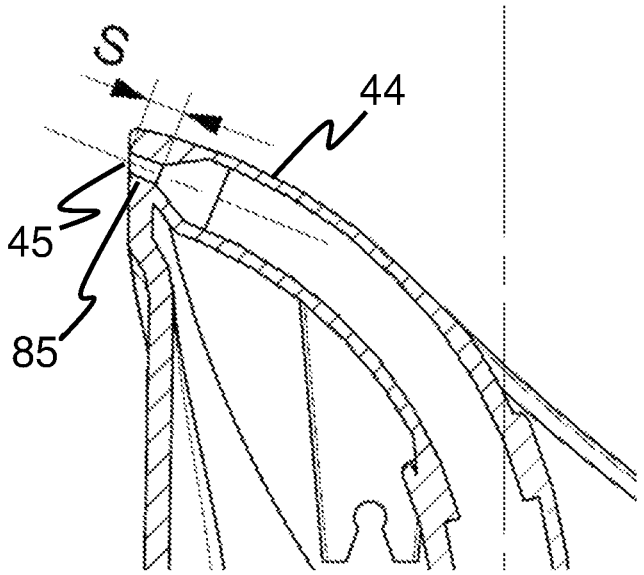
FIG. 16 shows a detail of the actuating device of the second embodiment with the rim of the discharge orifice.

As can be seen in FIG. 16 the discharge orifice 11; 45 may be provided by a circular rim 86 of the discharge duct 44 and the rim 85 has a thickness S between 0 and 2.0 mm to reduce the amount of residual product outside the discharge orifice 45.

Figure 17:
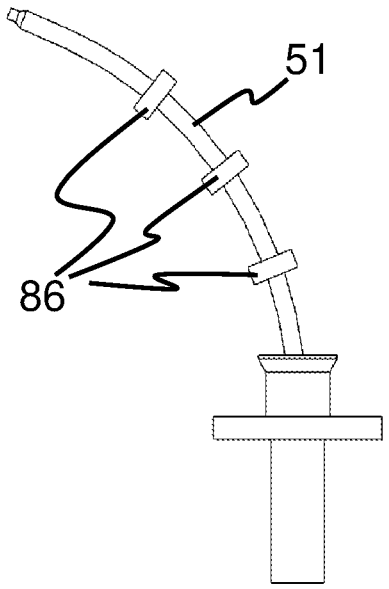
FIG. 17 shows a curved flexible rod with guiding elements.

The inner wall of the discharge duct 44 may further be provided with longitudinal guiding ribs to prevent against twisting or buckling of the inner rod 51. Further, as can be seen in FIG. 17, the inner rod 51 may be provided with guiding elements 86 on the flexible rod 51 which cooperate with the longitudinal guiding ribs.

Figure 18:
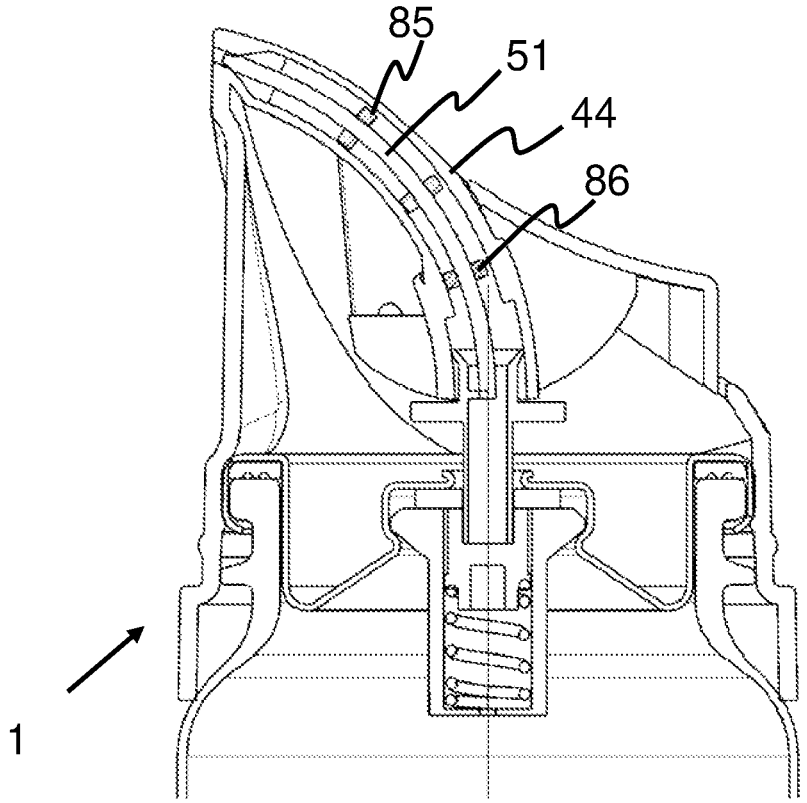
FIG. 18 shows the flexible rod of FIG. 17 in the actuating device of the second embodiment.

FIG. 18 shows the actuating device 1 with flexible rod 51 provided with the guiding elements 86 in the discharge duct 44.

Since all material of the embodiments of the actuating device 1 are made of plastic material the used fluid container can be recycled very efficiently. Since the parts made from PET have a density higher than 1 g/cm$^3$, the parts of plastic material different from PET as PP and LDPE can be separated easily in common separation facilities.

The invention claimed is:

1. Actuating device for use in combination with a packaging or fluid container pressurized by a propellant gas comprising an actuator head having a discharge orifice, a discharge duct in the actuator head which discharge duct connects the discharge orifice with an entry port, remote from the orifice, which actuating device is provided for actuating a resilient biased valve means for dispensing the fluid from the fluid container by the propellant gas, characterized in that the actuating device comprises an open piston having an open front end, an open rear end and at least an upper sealing lip at the open rear end which is sealing towards an inner wall of the discharge duct, an inner rod attached to the open piston, which inner rod having a free end, which free end is closing the discharge orifice from the inside of the discharge duct, wherein the open piston is biased towards the discharge opening, the actuator head comprising a lever or a push button for actuating the open piston to release the discharge orifice, wherein the discharge duct is curved and the inner rod is made from a flexible plastic material, in order to adapt to the curved discharge duct.

2. Actuating device according to claim 1, characterized in that the open piston has a larger diameter at the front end as the diameter at the rear end, such that an overpressure of the propellant gas in the packaging urges the inner rod towards the discharge orifice, thus providing the resilient biased valve means.

3. Actuating device according to claim 2, characterized in that the actuating device comprises an upper container closure with an outer upstanding rim and an inner central tube for closing the packaging or fluid container.

4. Actuating device according to claim 3, characterized in that additional resilient means are provided between the upper container closure and an outstanding flange of the open piston for supporting the biasing force on the open piston.

5. Actuating device according to claim 4, characterized in that the additional resilient means are bellows.

6. Actuating device according to claim 4, characterized in that the additional resilient means is a spring made of metal or plastic which is provided between the upper container closure and a lower end of the open piston.

7. Actuating device according to claim 4, characterized in that the push button has an inner cam which is actuating the outstanding flange of the open piston.

8. Actuating device according to claim 1, characterized in that the open piston is provided to actuate a straight actuating valve with a valve mechanism biased by a metal spring of the packaging fluid container.

9. Actuating device according to claim 1, characterized in that the elements thereof are made from a plastic material.

10. Actuating device according to claim 9, characterized in that the inner wall of the discharge duct is provided with longitudinal guiding ribs to prevent against twisting or buckling of the inner rod.

11. Actuating device according to claim 10, characterized in that the inner rod is provided with guiding elements which cooperate with the longitudinal guiding ribs.

12. Actuating device according to claim 1, characterized that the open piston having two opposite upstanding ribs for actuating by the lever, whereas the open piston with the inner rod, the free end and the upstanding ribs is made of one piece from a plastic material.

13. Actuating device according to claim 1, characterized in that the discharge orifice is provided by a circular rim of the discharge duct and the rim has a thickness between 0 and 2.0 mm to reduce the amount of residual product outside the discharge orifice.

* * * * *